US006648464B1

(12) United States Patent
Parazak

(10) Patent No.: US 6,648,464 B1
(45) Date of Patent: Nov. 18, 2003

(54) SYSTEMS AND METHODS FOR SERVICING INK-JET PENS CONTAINING REACTIVE INKS

(75) Inventor: Dennis P Parazak, Oceanside, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/236,634

(22) Filed: Sep. 6, 2002

(51) Int. Cl.[7] ..... B41J 2/01
(52) U.S. Cl. ..... 347/100; 347/28; 347/95
(58) Field of Search ..... 347/28, 33, 31, 347/20, 95, 100, 44, 96

(56) References Cited

U.S. PATENT DOCUMENTS 5,825,380 A * 10/1998 Ichizawa et al. ..... 347/28
5,905,514 A 5/1999 Rhoads et al.
5,907,355 A 5/1999 Kotaki
5,914,734 A 6/1999 Rotering et al.
5,917,512 A * 6/1999 Weber et al. ..... 347/28
5,969,731 A 10/1999 Michael et al.
6,206,497 B1 * 3/2001 Miura et al. ..... 347/28
6,286,952 B1 * 9/2001 Ando et al. ..... 347/95

* cited by examiner

*Primary Examiner*—Stephen D. Meier
*Assistant Examiner*—Manish Shah

(57) ABSTRACT

The present invention is drawn to systems and methods for remediating printhead cross-contamination wherein at least one of the ink-jet inks has undergone crashing. Specifically, a method of minimizing or reversing crashing of a first ink-jet ink that has reacted with a second ink-jet ink on a printhead can comprise the steps of dispensing a reactive cleaning fluid that is chemically configured to react with the first ink-jet ink after crashing; and cleaning a printhead having a crashed inkjet ink thereon with the reactive cleaning fluid, thereby minimizing or reverse crashing at the printhead.

25 Claims, No Drawings

SYSTEMS AND METHODS FOR SERVICING INK-JET PENS CONTAINING REACTIVE INKS

FIELD OF THE INVENTION

The present invention is drawn to the area of servicing ink-jet imaging pens. More specifically, the present invention is drawn to servicing ink-jet imaging pens such that two or more ink-jet pens containing ink-jet inks that are reactive with one another can share a common service station, or can utilize a common printhead.

BACKGROUND OF THE INVENTION

Computer printer technology has evolved to a point where very high resolution images can be transferred to various types of media, including paper. One particular type of printing involves the placement of small drops of a fluid ink onto a media surface in response to a digital signal. Typically, the fluid ink is placed or jetted onto the surface without physical contact between the printing device and the surface.

There are several reasons that ink-jet printing has become a popular way of recording images on various media surfaces, particularly paper. Some of these reasons include low printer noise, capability of high-speed recording, and multi-color recording. Additionally, these advantages can be obtained at a relatively low price to consumers. However, though there has been great improvement in ink-jet printing, accompanying this improvement are increased demands by consumers in this area, e.g., higher speeds, higher resolution, full color image formation, increased stability, etc.

In general, ink-jet inks are either dye- or pigment-based inks. Both are typically prepared in a liquid vehicle that contains the dye and/or the pigment. Dye-based ink-jet inks generally use a liquid colorant that is usually water-based to turn the media a specific color. Conversely, pigmented inks typically use a solid or dispersed colorant to achieve color.

Many properties that are desirable for ink-jet printing include good edge acuity and optical density of an image on a media substrate, good dry time of the ink on the substrate, adhesion to the substrate, lack of deviation of ink droplets when fired, presence of all dots, resistance of the ink after drying to water and other solvents, long-term storage stability, good dot size and dot gain, color-to-color bleed alleviation, acceptable coalescence, long term reliability without corrosion or nozzle clogging, good light fastness, good wet fastness, low humid hue shift, and other known properties. Many inks are known to possess some of the above described properties. However, few inks are known that possess all of these properties, since an improvement in one property often results in the degradation in another property. Accordingly, investigations continue into developing ink formulations that have improved properties and that do not improve one property at the significant detriment of another. However, many challenges still remain to further improve the image quality of ink-jet prints without sacrificing pen performance and reliability.

To illustrate advancement in the art that has evolved, there has been great interest in the area of reactive inks. These inks are designed such that a reaction occurs between two different ink colors at a border between the colors, e.g., an interaction such as precipitation occurs. This interaction can improve the edge acuity and/or color to color bleed between inks. For example, in order to have good black to color bleed and halo control, many ink-jet ink sets have been designed so that contact between the black and color inks promote destabilization of the black color causing it to agglomerate on the page. This can be accomplished by adding materials to the color inks that cause "crashing" of the black, usually acids or multivalent metal salts. Because of this reactivity, it has not been practical to put a reactive black and a multivalent salt- or acid-containing color ink set on the same printhead since agglomeration of the colorant may lead to clogging of the nozzles when the inks inevitably cross-contaminate. Because of this limitation, printhead configurations of reactive inks have often been limited to variations where reactive inks do not share a common printhead, e.g., three color pen and black pen are separate, or where each color has its own printhead.

In the prior art, care has been taken to avoid cross-contamination of printheads containing inks designed to be reactive with one another. One solution used to avoid cross-contamination, as mentioned, has been to provide separate service stations for inks intended to be reactive with one another. However, this is not always the most convenient arrangement. As alluded to, inkjet printers generally have one or more printhead service station(s) to which an ink-jet printhead is moved by a carriage. A cap that contacts or covers the printhead is also generally located at the service station. Further, at the service station, the printhead (or multiple heads if such are used) are occasionally cleaned and, if necessary, primed with ink. For use in this cleaning function, wipers can be present and located at the service station. The service station can also include a "sled" carrying these elements and others required to service the one or more printheads of the printer. This sled itself can be moved transversely to an axis of motion of the printhead carriage, for example in a vertical direction, so as to bring the caps or wipers into or out of contact with the printhead. Alternatively, a tumbler can be provided at the service station, and wipers, as well as caps, can be located on the tumbler. Rotation (and in some cases also vertical movement) of the tumbler effects wiping of the printhead, and/or alignment of one or more caps with one or more printheads positioned adjacent the tumbler at the service station. Though wiper and solvent systems are described in the prior art, the problems associated with cross-contamination of two reactive inks using a common service station or printhead has not been fully addressed.

SUMMARY OF THE INVENTION

It has been recognized that the use of certain components in ink-jet pen cleaning systems can provide acceptable printhead cleaning properties, even when two reactive inks are provided in multiple ink-jet pens sharing a common service station, a common printhead, or are in close proximity, thereby contributing to cross-contamination. Specifically, a method of printing two ink-jet inks reactive with one another from a printer having a common printhead while maintaining pen reliability can comprise the steps of jetting a first ink-jet ink from a common printhead and jetting a second ink-jet ink from the common printhead. The contacting of the inks from the common printhead results in the crashing of at least one of the inks thereby forming a crashed ink. The method further comprises dispensing a reactive cleaning fluid onto the printhead before or after crashing occurs, wherein the reactive cleaning fluid is chemically configured to react with the crashed ink, thereby minimizing or reverse crashing at the printhead.

In a further detailed aspect, a method of minimizing or reversing crashing of a first ink-jet ink that has reacted with a second ink-jet ink on a printhead can comprise the steps of (a) dispensing a reactive cleaning fluid that is chemically configured to react with the first ink-jet ink after crashing; and (b) cleaning a printhead having a crashed ink-jet ink thereon with the reactive cleaning fluid, thereby minimizing or reverse crashing at the printhead.

With respect to a related system, an ink-jet printing system can comprise a first ink-jet ink and a second ink-jet ink that is reactive with the first ink-jet ink such that when the first ink-jet ink contacts the second ink-jet ink, crashing of one of the first ink-jet ink and the second ink-jet ink occurs. The system can further comprise printing architecture configured for jetting the first ink-jet ink and the second ink-jet ink onto a substrate, wherein cross-contamination between the first ink-jet ink and the second ink-jet ink can occur on a printhead. A reactive cleaning fluid formulated to minimize or reverse crashing that occurs on the at least one printhead upon contact between the first ink-jet ink and the second ink-jet ink can also be present, such as can be present in a dispenser apparatus for holding a reservoir of reactive cleaning fluid and for dispensing the reactive cleaning fluid onto the printhead.

With respect to both the methods and systems, the reactive cleaning fluid can be any fluid that is formulated to minimize or reverse crashing. For example, the reactive cleaning fluid can be a basic liquid material if one of the ink-jet links is crashed by a second acidic ink. In one embodiment, such a basic material can comprise a composition such as sodium hydroxide, potassium hydroxide, or lithium hydroxide. In another embodiment, the reactive cleaning fluid can be a pH buffer that buffers at about pH 8 or higher. Alternatively, the reactive cleaning fluid can comprise a chelating agent such as, for example, ethylenediaminetetraacetic acid (EDTA). Though a basic liquid- or chelating agent-containing material can be used, the invention does not solely rest with these examples. Any chemical compound that can be used to minimize or reverse chemical crashing of one or more ink-jet ink is considered within the scope of the present invention. In other words, the invention is drawn to, in part, the chemical matching of the reactive cleaning fluid to the chemical properties of a crashed ink-jet ink that occurs after cross-contamination at a printhead.

DETAILED DESCRIPTION OF THE PREFERRED EMBODIMENT(S)

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It must be noted that, as used in this specification and the appended claims, the singular forms "a," "an," and "the" include plural referents unless the content clearly dictates otherwise.

As used herein, "effective amount" refers to the minimal amount of a substance or agent, which is sufficient to achieve a desired effect. For example, an effective amount of a "liquid vehicle" is the minimum amount required for use in a composition such as an ink-jet ink, while maintaining properties in accordance with embodiments of the present invention.

"Crashing" or "crashed" refers to the effect of one ink-jet ink on another ink-jet ink, wherein a chemical change occurs causing agglomeration, precipitation, or other reaction mechanism. This is desired in some ink-jet ink printing systems to reduce bleed and halo of a printed image. However, if crashing occurs at an ink-jet printhead, reliability problems such as clogging, misdirected ink, and the like can occur. In some systems, reactive inks can be crashed by multivalent salts, e.g., containing multivalent metal ions, as can be present in multivalent salt-containing ink-jet inks. In other systems, reactive inks can be crashed by an acid, as can be present in an acidic ink-jet ink.

"Reactive cleaning solution" refers to a liquid composition as a solution, dispersion, or in its neat form, that chemically reacts with crashed ink-jet inks to minimize or even reverse the effects of crashing.

It has been recognized that systems and methods for servicing ink-jet pens on an ink-jet printer where at least two ink-jet inks reactive with one another are present on the same printhead and/or share a common service station can be arranged. Typically, ink-jet printers contain cyan, magenta, yellow, and optionally, black ink-jet inks. Other numbers of ink-jet inks in a common printer are also occasionally used. For example, six ink systems are reasonably common and include black ink, yellow ink, two cyan inks, and two magenta inks. With many of these systems, it is desirable to share a common printhead and/or a common service station. However, if two inks sharing a common printhead and/or common service station are reactive with one another, clogging or other undesirable occurrences at the printhead can occur more readily. For example, some ink-jet printers utilize cyan, magenta, and yellow dye-based ink-jet inks that are designed to react with pigment-based black ink-jet inks such that precipitation occurs at contact, thereby reducing black to color bleed, halo, and other undesirable attributes. Trying to utilize these reactive inks on the same printhead causes clogged nozzles when the black and color inks cross-contaminate. By using fluids that are specifically selected to react with the cross-contaminated printheads, or to prevent reaction upon cross-contamination, better reliability can be achieved from pens sharing a printhead and/or service station.

Specifically, pH buffer-containing compositions, chemically basic compositions and/or chelating agent-containing compositions can be used to minimize and or reverse printhead cross-contamination before or after its occurrence. They can be applied as a fluid, or in their neat form, as long as the viscosity and volatility of the fluids are within a practical range for extended use. The process of treating a printhead before cross-contamination as a preventative measure, or after cross-contamination as a reversing measure, can be accomplished by aspirating, wiping, or by other known cleaning methods.

In one example, in the case where acidic color inks are used to "crash" a black ink, a pH buffer or basic liquid material or solution, such as for use with a wiper fluid, can be used. In the case where a black ink-jet ink is crashed by a multivalent ion-containing color ink, a liquid material or solution containing a chelating agent, such as for use with a wiper fluid, can be used. By one of these exemplary embodiments, it is possible to print reactive inks from the same printhead, or from separate printheads that share a common service station. The pH buffer or basic material, or chelating agent used in the fluid assisted cleaning, e.g., wiping, can help keep the nozzles healthy by periodically neutralizing the acidic environment on the printhead or by sequestering the multivalent cations, respectively. This averts the buildup of precipitates either by preventing agglomeration or precipitation, or by reversing agglomerate or precipitate formation.

With this in mind, a method of printing two ink-jet inks reactive with one another from a printer having a common printhead while maintaining pen reliability can comprise the steps of (a) jetting a first ink-jet ink from a common printhead; (b) jetting a second ink-jet ink from the common printhead, wherein the second ink-jet ink is reactive with the first ink-jet ink such that when the first ink-jet ink contacts the second ink-jet ink at the printhead, crashing of at least one of the first ink-jet ink and the second ink-jet ink occurs forming a crashed ink; and (c) dispensing reactive cleaning fluid onto the printhead before or after crashing occurs, wherein the reactive cleaning fluid is chemically configured to react with the crashed ink, thereby minimizing or reverse crashing at the printhead.

In one embodiment, the first ink-jet ink can be crashed by the second ink-jet ink, and the second ink-jet ink can be acidic. In such an embodiment, the reactive cleaning fluid can be a basic liquid material or buffer, such as sodium hydroxide solution, potassium hydroxide solution, lithium hydroxide solution, tris base solution (trimethylol amino methane) (can buffer at about pH 8), boric acid/sodium hydroxide solution (can buffer at about pH 8), glycine/sodium hydroxide solution (can buffer at about pH 8), N-tris(hydroxymethyl)methylglycine (can buffer at about pH 8), triethanolamine, for example. Alternatively, the first ink-jet ink can be crashed by the second ink-jet ink wherein the second ink-jet ink contains a multivalent salt. In this embodiment, the reactive cleaning fluid can comprise a chelating agent, such as ethylenediaminetetraacetic acid (EDTA), ethylenediaminebis (2-hydroxyphenylacetic acid) (EDDHA), porphine, and lauroyl-modified EDTA (Hampshire LED3A Na, from Hampshire: Lexington, Mass.; a Division of the Dow Chemical Company), for example.

In an alternative embodiment, a method of minimizing or reversing crashing of a first ink-jet ink that has reacted with a second ink-jet ink on a printhead can comprise the steps of dispensing a reactive cleaning fluid that is chemically configured to react with the first ink-jet ink after crashing; and cleaning a printhead having a crashed ink-jet ink thereon with the reactive cleaning fluid, thereby minimizing or reverse crashing at the printhead. Again, if the crashing occurs by the presence of a multivalent salt, a chelating agent as describe above can be used. If the crashing occurs by the presence of an acid, a basic material can be used as describe previously.

In one embodiment, the first ink-jet ink and the second ink-jet ink can be jetted from a common printhead. Cross-contamination is likely with such a configuration. As a result, cleaning with a reactive cleaning fluid may be desired. However, cross-contamination can occur with other arrangements as well. For example, two separate printheads can cross-contaminate, such as when two printheads share a common service station, wiper blade, or the like. Likewise, if two printheads are too close in proximity, cross-contamination can occur by way of aerosol contamination, i.e., stray aerosol spray cross-contamination. If a common wiper is used for multiple printheads, cross-contamination can be remediated by way of the use of the reactive cleaning composition. Though the cleaning is preferably carried out by wiping at the service station, other cleaning techniques can be used as would be apparent to those skilled in the art after reading the present disclosure, e.g., aspirating.

In another embodiment, an ink-jet printing system can comprise a first ink-jet ink and a second ink-jet ink that is reactive with the first ink-jet ink such that when the first ink-jet ink contacts the second ink-jet ink, crashing of one of the first ink-jet ink and the second ink-jet ink occurs. Further, printing architecture can be present that is configured for jetting the first ink-jet ink and the second ink-jet ink onto a substrate, wherein cross-contamination between the first ink-jet ink and the second ink-jet ink can occur on at least one printhead. To prevent or reverse such crashing, a reactive cleaning fluid formulated to minimize or reverse crashing that occurs on the at least one printhead upon contact between the first ink-jet ink and the second ink-jet ink can be present. Such a composition can be dispensed by a dispenser apparatus for holding a reservoir of reactive cleaning fluid, and for dispensing the reactive cleaning fluid onto the at least one printhead.

Like the previous embodiment, the first ink-jet ink can be crashed by the second ink-jet ink that is acidic. In this embodiment, the reactive cleaning fluid can be a basic liquid material or buffer, e.g., sodium hydroxide solution, potassium hydroxide solution, lithium hydroxide solution, tris base solution (trimethylol amino methane), boric acid/sodium hydroxide solution, glycine/sodium hydroxide solution, N-tris(hydroxymethyl)methylglycine, triethanolamine, and the like. Alternatively, the first ink-jet ink can be crashed by the second ink-jet ink wherein the second ink-jet ink contains a multivalent salt. There, the reactive cleaning fluid can comprise a chelating agent, e.g., EDTA, ethylenediaminebis (2-hydroxyphenylacetic acid) (EDDHA), porphine, and lauroyl-modified EDTA (Hampshire LED3A Na, from Hampshire: Lexington, Mass.; a Division of the Dow Chemical Company), and the like.

There are various ways that two ink-jet inks that are reactive with one another can become cross-contaminated on printing architecture. For example, the printing architecture comprises a common printhead for printing both the first ink-jet ink and the second ink-jet ink. A common printhead would have jetting orifices in close proximity such that any excess ink may come in contact at or near a pen orifice. Alternatively, if the printing architecture comprises a first printhead and a second printhead, if they are in close enough proximity, or share a service station, the one or more printhead can be cross-contaminated due to service station contamination or aerosol spray contamination. A service station component that could transfer reactive inks to undesired locations can include a service station wiper. In one embodiment, if a common wiper has reactive cleaning solution thereon, a common wiper could be used without significant adverse affects.

Though the embodiments described herein are put forth with respect to two ink-jet inks that are reactive, other configurations are also possible. For example, a three-, four-, five-, or six-pen (or more) configuration could benefit from the methods and systems of the present invention. For example, a four-pen system comprising acidic cyan, acidic magenta, and acidic yellow can be used with a reactive black ink-jet ink, such that the black ink-jet ink becomes crashed upon contact. In accordance with principles of the present invention, one or more of the color ink-jet inks could share a printhead with the black ink-jet ink without adverse clogging, as the reactive cleaning solution would be able to minimize or reverse agglomeration or crashing using a cleaning mechanism such as wiping. Alternatively, if separate printheads are used for each ink-jet ink, a single wiper could be used to clean all printheads due to the presence of the reactive cleaning solution, as cross-contamination would not create reliability problems due to cleaning solution being specifically formulated to minimize and reverse the adverse affects of cross-contamination crashing. The same would be true of other ink-jet ink arrangements, such as with six-pen ink sets and other ink sets known in the art.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following Examples provide further detail in connection with what are presently deemed to be the most practical and preferred embodiments of the invention.

Example 1

The color inks examined herein were from two reactive classes: 1) inks containing multivalent metal salts, e.g., cyan and magenta inks from the Hewlett-Packard DeskJet 970; and 2) inks containing organic acids at pH 4, e.g., cyan and magenta inks from the Hewlett-Packard Business Inkjet 2250 printer and Hewlett-Packard Color lnkjet Printer CP 1160 magenta ink. The reactive black ink was from the Hewlett-Packard Business lnkjet 2250 printer.

Specifically, the color inks were added separately to the black ink in multiple test tubes yielding a total sample size of approximately 2 grams each. The mixtures contained various ratios of color in black mixtures ranging from 0% color to about 90% color by weight, as seen in Tables 1 to 5 below. The tubes were each shaken vigorously, and the particle size was measured on each sample using a Microtrac particle size analyzer. Typically, with respect to the mixtures, the particles had grown about an order of magnitude. EDTA and NaOH were then added to the "crashed" inks in slight stoichiometric excess of their metal ion or acid concentrations, respectively (see Tables 1 to 5). After mixing, the particle size was determined again. Note that the particle size of the "crashed" inks, in most cases, is reduced indicating that the crashing of these inks is at least partially reversible. This is especially the case with respect to the acid containing reactive color inks. In other words, the fact that the particle size partially recovers indicates that intermittent wiping of the printhead with either a basic material or a chelating agent (depending on the type of crashing that occurs) will prevent or reverse the formation of agglomerated ink in the case of cross-contamination of reactive inks. Inks present in the color/black ink mixture are provided to the nearest 0.1 weight percentage; particle size is provided to the nearest 0.05 micron; and the amount of EDTA or NaOH is provided to the nearest 0.001 g.

TABLE 1

Mean Volume Particle Size vs. Weight Percent for DeskJet 970 Magenta Ink mixed with Reactive Black Ink (Before and After EDTA Added)

| Magenta Ink Present (wt %) | Reactive Black Ink Present (wt %) | Particle Size Before EDTA Added (:m) | Amount EDTA Added (g) | Particle Size After EDTA Added (:m) |
|---|---|---|---|---|
| 0.0 | 100.0 | 0.10 | 0.000 | 0.10 |

TABLE 1-continued

Mean Volume Particle Size vs. Weight Percent for DeskJet 970 Magenta Ink mixed with Reactive Black Ink (Before and After EDTA Added)

| Magenta Ink Present (wt %) | Reactive Black Ink Present (wt %) | Particle Size Before EDTA Added (:m) | Amount EDTA Added (g) | Particle Size After EDTA Added (:m) |
|---|---|---|---|---|
| 10.0 | 90.0 | 1.20 | 0.020 | 0.55 |
| 20.5 | 79.5 | 1.25 | 0.054 | 0.30 |
| 30.5 | 69.5 | 1.20 | 0.064 | 0.40 |
| 39.7 | 59.3 | 1.20 | 0.086 | 0.50 |
| 48.7 | 51.3 | 1.20 | 0.115 | 0.70 |
| 59.8 | 41.2 | 1.05 | 0.125 | 0.85 |
| 70.0 | 30.0 | 1.00 | 0.141 | 0.95 |
| 79.6 | 20.4 | 1.30 | 0.167 | 1.25 |
| 88.8 | 11.2 | 1.30 | 0.189 | 1.30 |

TABLE 2

Mean Volume Particle Size vs. Weight Percent for DeskJet 970 Cyan Ink Mixed With Reactive Black Ink (Before and After EDTA Added)

| Cyan Ink Present (wt %) | Reactive Black Ink Present (wt %) | Particle Size Before EDTA Added (:m) | Amount EDTA Added (g) | Particle Size After EDTA Added (:m) |
|---|---|---|---|---|
| 0.0 | 100.0 | 0.10 | 0.000 | 0.10 |
| 10.3 | 89.7 | 1.20 | 0.027 | 0.45 |
| 20.3 | 79.7 | 1.20 | 0.075 | 0.55 |
| 30.1 | 69.9 | 1.15 | 0.072 | 0.65 |
| 40.2 | 59.8 | 0.95 | 0.083 | 0.75 |
| 49.9 | 50.1 | 0.95 | 0.109 | 0.90 |
| 61.0 | 39.0 | 1.10 | 0.128 | 1.10 |
| 69.3 | 29.7 | 1.55 | 0.146 | 1.10 |
| 79.6 | 20.4 | 1.65 | 0.158 | 1.25 |
| 89.6 | 10.4 | 1.50 | 0.192 | 1.30 |

TABLE 3

Mean Volume Particle Size vs. Weight Percent for HP Business InkJet 2250 Magenta Ink Mixed With Reactive Black Ink (Before and After NaOH Added)

| Magenta Ink Present (wt %) | Reactive Black Ink Present (wt %) | Particle Size Before NaOH Added (:m) | Amount NaOH Added (g) | Particle Size After NaOH Added (:m) |
|---|---|---|---|---|
| 0.0 | 100.0 | 0.10 | 0.000 | 0.10 |
| 10.5 | 89.5 | 1.20 | 0.009 | 0.10 |
| 20.2 | 79.8 | 0.75 | 0.007 | 0.15 |
| 29.8 | 70.2 | 0.70 | 0.016 | 0.15 |
| 39.8 | 60.2 | 0.85 | 0.017 | 0.30 |
| 50.1 | 49.9 | 1.10 | 0.028 | 0.20 |
| 60.0 | 40.0 | 0.95 | 0.024 | 0.60 |
| 69.2 | 30.8 | 0.90 | 0.032 | 0.40 |
| 79.6 | 20.4 | 0.90 | 0.040 | 0.20 |
| 88.4 | 11.6 | 1.10 | 0.049 | 0.25 |

TABLE 4

Mean Volume Particle Size vs. Weight Percent for HP Business InkJet 2250 Cyan Ink Mixed With Reactive Black Ink (Before and After NaOH Added)

| Cyan Ink Present (wt %) | Reactive Black Ink Present (wt %) | Particle Size Before NaOH Added (:m) | Amount NaOH Added (g) | Particle Size After NaOH Added (:m) |
|---|---|---|---|---|
| 0.0 | 100.0 | 0.10 | 0.000 | 0.10 |
| 10.0 | 90.0 | 0.85 | 0.006 | 0.10 |
| 20.1 | 79.9 | 0.60 | 0.007 | 0.30 |
| 29.9 | 70.1 | 0.60 | 0.016 | 0.10 |
| 39.8 | 60.2 | 0.75 | 0.017 | 0.10 |
| 51.0 | 49.0 | 0.70 | 0.023 | 0.10 |
| 60.5 | 39.5 | 0.75 | 0.023 | 0.10 |
| 70.0 | 30.0 | 0.70 | 0.026 | 0.15 |
| 79.5 | 20.5 | 0.65 | 0.032 | 0.10 |
| 89.4 | 10.6 | 0.70 | 0.035 | 0.15 |

TABLE 5

Mean Volume Particle Size vs. Weight Percent for Hewlett-Packard Color Inkjet Printer CP1160 Magenta Ink Mixed With Reactive Black Ink (before and After NaOH Added)

| Magenta Ink Present (wt %) | Reactive Black Present (wt %) | Particle Size Before NaOH Added (:m) | Amount NaOH Added (g) | Particle Size After NaOH Added (:m) |
|---|---|---|---|---|
| 0.0 | 100.0 | 0.10 | 0.000 | 0.10 |
| 10.6 | 89.4 | 1.10 | 0.006 | 0.10 |
| 19.9 | 80.1 | 1.00 | 0.010 | 0.20 |
| 30.5 | 69.5 | 0.90 | 0.013 | 0.30 |
| 40.2 | 59.8 | 1.15 | 0.024 | 0.20 |
| 50.2 | 49.8 | 1.30 | 0.024 | 0.30 |
| 60.4 | 39.6 | 1.30 | 0.023 | 0.70 |
| 69.4 | 30.6 | 1.10 | 0.026 | 0.75 |
| 80.0 | 20.0 | 1.15 | 0.031 | 0.70 |
| 89.9 | 10.1 | 1.15 | 0.037 | 0.70 |

Example 2

Wiper fluid A is prepared containing 0.9 g of aqueous 50% sodium hydroxide solution in 99.6 g of polyethylene glycol (PEG) 300. This results in a 0.4% NaOH solution which is approximately 0.1 moles/kg. A reactive black ink from the black pen of the Hewlett-Packard Professional Series 2250 is filled into the center chamber of an empty tri-color ink-jet pen (part #C1823) from the Hewlett-Packard DeskJet 840, and a yellow ink from Hewlett-Packard Professional Series 2250 is filled into the adjacent chambers. The reactive black ink has a pH of 8–9 and contains a pigment colorant. The yellow ink contains a dye-based colorant in an ink vehicle that is buffered at a pH of about 4. The pen is placed into a Hewlett-Packard DeskJet 840 printer and a black and yellow mixed text and graphics image is printed repeatedly. Every 10 pages, the pen is removed and the printhead wiped by hand with a text-wipe that is pre-wetted with wiper fluid A. Wiper fluid B, composed of PEG 300 alone, is tested in the same way as a control. The pen wiped with wiper fluid A exhibits significantly less nozzles clogged by the cross-contamination of the reactive ink set than the wiper fluid B control pen.

Example 3

Wiper fluid C is prepared containing 2.01 g of ethylenediaminetetraacetic acid disodium salt (EDTA-$Na_2$) in 98.09 g of deionized water. This results in a 2.0% EDTA-$Na_2$ solution that is approximately 0.07 moles/kg. The reactive black ink from the black pen of the Hewlett-Packard Professional Series 2250 is filled into the center chamber of an empty tri-color ink-jet pen (part #C1823) from the DeskJet 840 and the yellow color ink from Hewlett-Packard DeskJet 970Cxi is filled into the adjacent chambers. The black ink has a pH of 8–9 and contains a pigment colorant. The yellow ink contains a dye-based colorant in an ink vehicle that has several percent multivalent metal cations and buffered at a pH of about 6–7. The pen is placed into a Hewlett-Packard DeskJet 840 printer and a black and yellow mixed text and graphics image is printed repeatedly. Every 10 pages, the pen is removed and the printhead wiped by hand with a text-wipe that is pre-wetted with wiper fluid C. Wiper fluid D, composed of deionized water alone, is tested in the same way as a control. The pen wiped with wiper fluid C exhibits significantly less nozzle clogging due to cross-contamination of the reactive ink set than the control pen of wiper fluid D.

Example 4

Wiper fluid E is prepared containing 4.27 g of Hampshire N-Acyl ED3A (a lauroyl modified EDTA from Hampshire: Lexington, Mass.; a Division of the Dow Chemical Company) in 97.93 g of PEG 300. This results in a 4.2% ED3A solution that is approximately 0.10 moles/kg. The black ink from the black pen of the Hewlett-Packard Professional Series 2250 is filled into the center chamber of an empty tri-color ink-jet pen (part #C1823) from the DeskJet 840 and the yellow color ink from Hewlett-Packard DeskJet 970Cxi is filled into the adjacent chambers. The black ink has a pH of 8–9 and contains a pigment colorant. The yellow ink contains a dye based colorant in an ink vehicle that has several percent multivalent metal cations and buffered at a pH of about 6–7. The pen is placed into a Hewlett-Packard DeskJet 840 printer and a black and yellow mixed text and graphics image is printed repeatedly. Every 10 pages, the pen is removed and the printhead wiped by hand with a text-wipe that is pre-wetted with wiper fluid E. Wiper fluid B from Example 1, is tested in the same way as a control. The pen wiped with wiper fluid E has significantly less nozzles clogged by the cross contamination of the reactive ink set than the control pen of wiper fluid B.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

What is claimed is:

1. A method of printing two inkjet inks reactive with one another from a printer having a common printhead while maintaining pen reliability, comprising:

a) jetting a first ink-jet ink from a common printhead;

b) jetting a second ink-jet ink from the common printhead, wherein the second ink-jet ink is reactive with the first ink-jet ink such that when the first ink-jet ink contacts the second ink-jet ink at the printhead, crashing of at least one of the first ink-jet ink and the second ink-jet ink occurs forming a crashed ink; and c) dispensing reactive cleaning fluid onto the printhead before or after crashing occurs, wherein the reactive cleaning fluid is chemically configured to react with the crashed ink, thereby minimizing or reversing crashing at the printhead.

2. A method as in claim 1, wherein the first ink-jet ink is crashed by the second ink-jet ink, wherein the second ink-jet ink is acidic, and wherein the reactive cleaning fluid is a buffer or basic liquid material.

3. A method as in claim 2, wherein the buffer or basic liquid material is a member selected from the group consisting of sodium hydroxide solution, potassium hydroxide solution, lithium hydroxide solution, tris base solution, boric acid/sodium hydroxide solution, glycine/sodium hydroxide solution, N-tris(hydroxymethyl)methylglycine, triethanolamine, and combinations thereof.

4. A method as in claim 1, wherein the first ink-jet ink is crashed by the second ink-jet ink, wherein the second ink-jet ink contains a multivalent salt, and wherein the reactive cleaning fluid comprises a chelating agent.

5. A method as in claim 4, wherein the chelating agent is selected from the group consisting of EDTA, EDDHA, porphine, lauroyl-modified EDTA, and combinations thereof.

6. A method of reversing crashing of a first ink-jet ink that has been crashed by a second ink-jet ink at a printhead, comprising:

a) dispensing a reactive cleaning fluid that is chemically configured to react with the first ink-jet ink after crashing; and b) cleaning a printhead having a crashed inkjet ink thereon with the reactive cleaning fluid, thereby reversing crashing at the printhead.

7. A method as in claim 6, wherein the first ink-jet ink and the second ink-jet ink are jetted from a common printhead.

8. A method as in claim 6, wherein the first ink-jet ink and the second ink-jet ink are jetted from a first printhead and a second printhead, respectively.

9. A method as in claim 8, wherein the cleaning step occurs on the first printhead and the second printhead.

10. A method as in claim 6, wherein the cleaning step is by wiping.

11. A method as in claim 6, wherein the reactive cleaning fluid is a buffer of basic liquid material.

12. A method as in claim 11, wherein the buffer or basic liquid material is a member selected from the group consisting of sodium hydroxide solution, potassium hydroxide solution, lithium hydroxide solution, tris base solution, boric acid/sodium hydroxide solution, glycine/sodium hydroxide solution, N-tris(hydroxymethyl)methylglycine, triethanolamine, and combinations thereof.

13. A method as in claim 6, wherein the reactive cleaning fluid comprises a chelating agent.

14. A method as in claim 13, wherein the chelating agent is selected from the group consisting of EDTA, EDDHA, porphine, lauroyl-modified EDTA, and combinations thereof.

15. An ink-jet printing system, comprising:

a) a first ink-jet ink;

b) a second ink-jet ink that is reactive with the first ink-jet ink such that when the first ink-jet ink contacts the second ink-jet ink, crashing of one of the first ink-jet ink and the second ink-jet ink occurs;

c) printing architecture configured for jetting the first ink-jet ink and the second ink-jet ink onto a substrate, wherein cross-contamination between the first ink-jet ink and the second ink-jet ink can occur on a printhead;

d) a reactive cleaning fluid formulated to minimize or reverse crashing that occurs on the printhead upon contact between the first ink-jet ink and the second ink-jet ink; and e) a dispenser apparatus for holding a reservoir of reactive cleaning fluid, and for dispensing the reactive cleaning fluid onto the at least one printhead.

16. A system as in claim 15, wherein the first ink-jet ink is crashed by the second ink-jet ink, wherein the second ink-jet ink is acidic, and wherein the reactive cleaning fluid is a buffer or basic liquid material.

17. A system as in claim 16, wherein the buffer or basic liquid material is a member selected from the group consisting of sodium hydroxide solution, potassium hydroxide solution, lithium hydroxide solution, tris base solution, boric acid/sodium hydroxide solution, glycine/sodium hydroxide solution, N-tris(hydroxymethyl)methylglycine, triethanolamine, and combinations thereof.

18. A system as in claim 15, wherein the first ink-jet ink is crashed by the second ink-jet ink, wherein the second ink-jet ink contains a multivalent salt, and wherein the reactive cleaning fluid comprises a chelating agent.

19. A system as in claim 18, wherein the chelating agent is selected from the group consisting of EDTA, EDDHA, porphine, lauroyl-modified EDTA, and combinations thereof.

20. A system as in claim 15, wherein the printing architecture comprises a common printhead for printing both the first ink-jet ink and the second ink-jet ink.

21. A system as in claim 15, wherein the printing architecture comprises a first printhead and a second printhead configured for printing the first ink-jet ink and the second ink-jet ink, respectively.

22. A system as in claim 15, wherein the disperser apparatus further comprises a wiper configured for wiping the printhead with the reactive cleaning fluid.

23. A system as in claim 15, wherein the cross-contamination occurs due to the sharing of a service station member.

24. A system as in claim 15, wherein the cross-contamination is aerosol-created.

25. A system as in claim 15, wherein the cross-contamination occurs because the first ink-jet ink and the second ink-jet ink share a common printhead.

* * * * *